US008356914B2

(12) United States Patent
Simon

(10) Patent No.: US 8,356,914 B2
(45) Date of Patent: Jan. 22, 2013

(54) LUMINAIRES AND OPTICS FOR CONTROL AND DISTRIBUTION OF MULTIPLE QUASI POINT SOURCE LIGHT SOURCES SUCH AS LEDS

(76) Inventor: Jerome H. Simon, Newton Centre, MA (US)

( * ) Notice: Subject to any disclaimer, the term of this patent is extended or adjusted under 35 U.S.C. 154(b) by 498 days.

(21) Appl. No.: 12/576,648

(22) Filed: Oct. 9, 2009

(65) Prior Publication Data

US 2010/0079995 A1 Apr. 1, 2010

Related U.S. Application Data

(63) Continuation-in-part of application No. 11/635,178, filed on Dec. 7, 2006, now Pat. No. 7,600,894.

(60) Provisional application No. 60/748,245, filed on Dec. 7, 2005.

(51) Int. Cl.
*F21V 5/00* (2006.01)

(52) U.S. Cl. ..... 362/245; 362/299; 362/304; 362/328; 362/800

(58) Field of Classification Search ..... 362/244, 362/245, 246, 299, 304, 237, 241, 242, 243, 362/268, 328, 337, 339, 340
See application file for complete search history.

(56) References Cited

U.S. PATENT DOCUMENTS

| | | | | |
|---|---|---|---|---|
| 1,929,020 | A | 10/1933 | Exelman | 40/557 |
| 2,088,024 | A | 7/1937 | Baber | 362/33 |
| 2,344,221 | A | 3/1944 | Trauiner | 362/297 |
| 2,867,716 | A | 1/1959 | Ream | 40/431 |
| 3,739,167 | A | 6/1973 | Avery | 362/157 |
| 3,739,169 | A | 6/1973 | Weinreich | 362/542 |
| 4,159,511 | A | 6/1979 | Dejonc | 362/299 |
| 4,263,641 | A | 4/1981 | Ferrero | 362/293 |
| 4,388,674 | A | 6/1983 | Sano | 362/186 |
| 5,043,850 | A | 8/1991 | Dreyer, Jr. | 362/26 |
| 5,057,974 | A | 10/1991 | Mizobe | 362/26 |
| 5,130,908 | A | 7/1992 | Simon | 362/150 |
| 5,258,896 | A | 11/1993 | Dreyer, Jr. | 362/307 |
| 5,383,105 | A | 1/1995 | Agut | 362/285 |
| 5,526,248 | A | 6/1996 | Endo | 362/538 |
| 5,530,628 | A | 6/1996 | Ngai | 362/33 |
| 5,765,934 | A | 6/1998 | Okamori et al. | 354/94 |
| 5,897,201 | A | 4/1999 | Simon | 362/268 |
| 5,913,599 | A | 6/1999 | Smith et al. | 362/328 |
| 5,951,139 | A | 9/1999 | Smith et al. | 362/33 |
| 6,270,236 | B1 | 8/2001 | Brussog | 362/249 |
| 6,447,155 | B2 | 9/2002 | Kondo et al. | 362/545 |
| 6,494,596 | B1 | 12/2002 | Burroughs | 362/348 |
| 6,575,601 | B1 | 6/2003 | Sitzema et al. | 362/340 |
| 6,698,908 | B2 | 3/2004 | Sitzema et al. | 362/328 |
| 7,025,476 | B2 | 4/2006 | Leadford | 362/309 |
| 7,083,304 | B2 | 8/2006 | Rhoads et al. | 362/293 |
| 7,111,969 | B2 | 9/2006 | Bottesch et al. | 362/517 |
| 2006/0291207 | A1 | 12/2006 | Simon | 362/245 |
| 2008/0030987 | A1 | 2/2008 | Simon | 362/234 |

*Primary Examiner* — Jong-Suk (James) Lee
*Assistant Examiner* — Leah S Macchiarolo
(74) *Attorney, Agent, or Firm* — Burns & Levinson LLP; Harvey Kaye

(57) ABSTRACT

A light projection device of a stack of at least 2 LED light projection modules. Each module shares a common optical axis and each includes an LED at least partially surrounded by an off-axis collimating optic and each projects a radially collimated canted beam towards and onto. There is a refracting plate for redirecting and changing the angle in respect to the optical axis of at least one of the radially collimated canted beams.

11 Claims, 17 Drawing Sheets

EX
DR
RR
LEDM
FP
CR
FB
RS
FB
DR
CR

RS
FB
EX
LEDM

B
RS
LEDM2
LEDM1
FB1
FB2
FB3
LEDM3

SFB

RS1
RS2
RS3
FB1
FB2
FB3
LEDM2
LEDM1

LEDM3
LEDM1
UFB
LEDM2
LEDM3
CB
RSS

SUFB
WP1
EX1
EX2
EX3
PB1
CA1
PB2
CA2
PB3
CA3
WP3

WP2

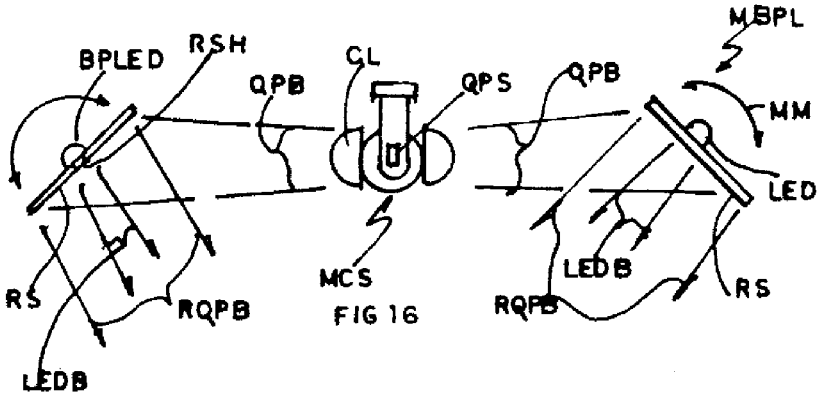
FIG 16
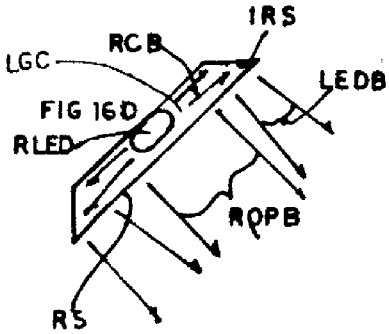
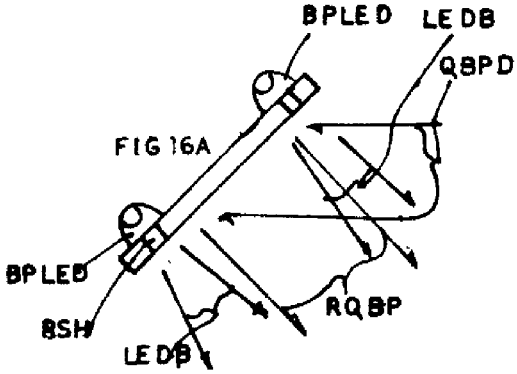
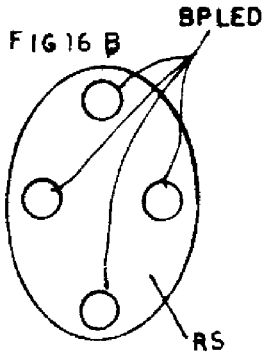
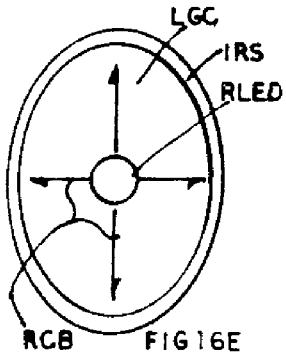
FIG 16E
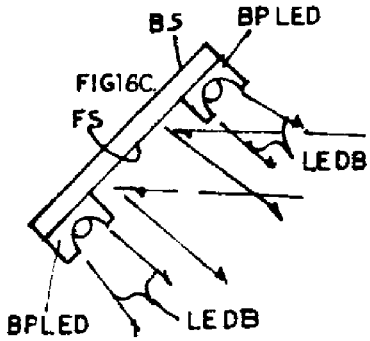

LUMINAIRES AND OPTICS FOR CONTROL AND DISTRIBUTION OF MULTIPLE QUASI POINT SOURCE LIGHT SOURCES SUCH AS LEDS

REFERENCE TO RELATED APPLICATIONS

The present application is a Continuation-In-Part of application Ser. No. 11/635,178, filed Dec. 7, 2006. The substance of that application is hereby incorporated herein by reference.

Application Ser. No. 11/635,178 claims priority from provisional application Ser. No. 60/748,245 filed Dec. 7, 2005. The substance of application Ser. No. 60/748,245 is hereby incorporated herein by reference The present inventor's prior patent application Ser. No. 11/034,395 filed Jan. 12, 2005 is hereby incorporated herein by reference.

The present inventor's prior U.S. Pat. No. 5,897,201 is hereby incorporated herein by reference.

FIELD OF INVENTION

This invention relates generally to the lighting art, and, more particularly to controlling and distributing light from multiple sources.

SUMMARY OF THE INVENTION

A purpose for this invention is to provide efficient lighting products, such as fixtures and light bulbs, that project beams of light from single or multiple light sources such as LEDs.

Another purpose of this invention is to provide lighting systems that can produce uniform and homogenized illumination from multiples of colored light sources.

Another purpose of this invention is to provide lighting systems that can illuminate objects and/or the environment with variable colored illumination without altering the pattern of light provided.

Another purpose for this invention is to provide an illumination system that can be manufactured, sold, and utilized as discrete modules which can be assembled into a variety of lighting products.

Another purpose for this invention is to provide a transparent lighting system that produces illumination of variable color and does not distort visual imaging.

Another purpose of this invention is to add light and color augmentation to high output quasi-point source lamps with LED light sources.

Another purpose for this invention is to provide full spectrum illumination to various types of architectural lighting requirements.

It is a further purpose of this invention to broaden the spectrum of illumination that is provided by luminaires using quasi-point source lamps that are limited in color.

Still further it is a purpose of this invention to provide full spectrum illumination to beam projecting devices for the purpose of accent lighting.

Yet another purpose of this invention is to provide full spectrum illumination to individual beams projected from the type of luminaire that provides multiple beams from a single lamp.

BRIEF DESCRIPTION OF THE DRAWINGS

These and other objects, features and advantages will be apparent from the following detailed description of preferred embodiments taken in conjunction with the accompanying drawings in which:

FIG. 11D is a cross-sectional diagram of a lighting assembly similar to FIG. 11C.

FIG. 12A is a three dimensional diagram of a lighting assembly as shown in FIG. 12 having a refractor shaped like a pyramid.

FIG. 16 is a sectional view of a lumenaire that divides the light from a single high intensity light source into individual beam integrating LED beam projecting devices.

FIG. 16A is a side view diagram of a component of FIG. 16.

FIG. 16B is a plan view diagram of a component of FIG. 16.

FIG. 16C illustrates an alternative construct to the component illustrated in FIG. 16B.

FIG. 16D illustrates another configuration for maintaining continuity between the light sources.

FIG. 16E is a planar diagram of FIG. 16D.

DETAILED DESCRIPTION OF PREFERRED EMBODIMENTS

Figure 11B:
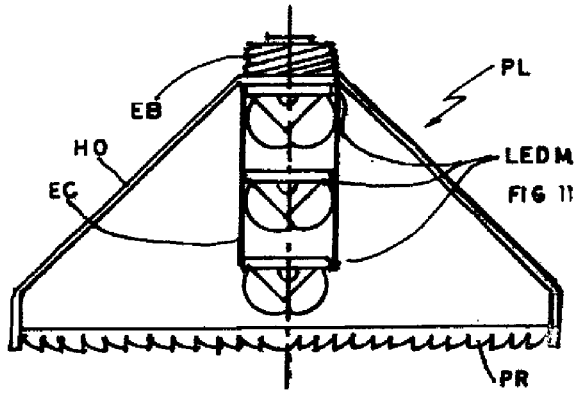
FIG. 11B is a cross-section of a light bulb comprising similar optical elements as illustrated in FIG. 11.
Figure 11:
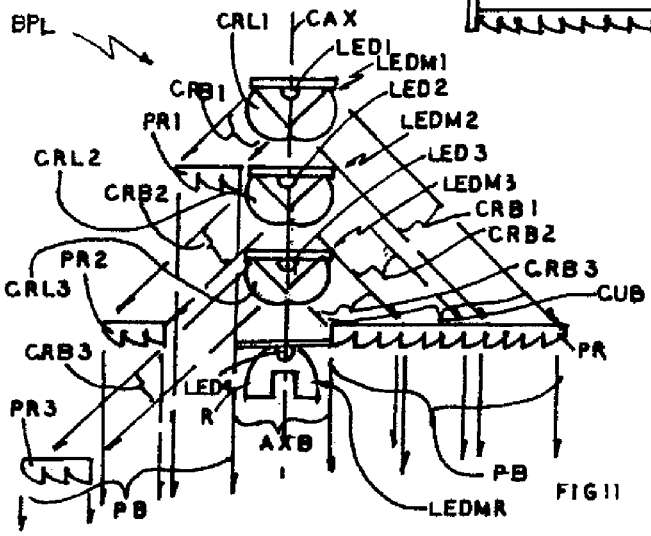
FIG. 11 is a cross-sectional diagram of a beam projecting lighting device comprising a stack of optical modules, projecting light onto and through a refracting plate.

FIG. 11 is a cross sectional diagram of a beam projecting lighting device BPL. The right and left side of the diagram show two different optical configurations for projecting a unified beam from multiple Quasi point light sources. BPL is comprised of a stack of three (but limited to that number) optical modules, LEDM1, LEDM2, and LEDM3, each containing a quasi point light source, respectively LED1 LED2 and LED3, each, at least partially surrounded by a radially light distributing optic, respectively CRL1 CRL2 and CRL3, each collecting and projecting light from it's respective LED as substantially collimated canted radial beams CRB1 CRB2.and CRB3, as a substantially unified beam CUB, towards and onto refracting plate PB, which in turn bends CUB into beam PB, the rays of which are at an angle to or are substantially parallel (depending on the optical configuration of PR) to optical axis CAX, which is common to all LEDs., LED1 LED2 and LED3 The stacking of quasi point light sources, and surrounding them with radially projecting and collimating optics is further taught in my co-pending application; Ser. No. 11/034,395. Shown on the left side of FIG. 11, each canted radial beamCRB1 CRB2 and CRB3 are intercepted and refracted by refracting rings PM, PR2, and PR3 as beam PB, (the function of which has been previously explained). Although the function of PB has been described as one of refraction, PB may also be configured as a diffuser. LEDMR, which is comprised of LED4 and reflector R (which may be reflective or internally reflective, and circular, ellipsoidal, or parabolic in section) which projects beam AXB. Although R of LEDMR can be molded as part of PR, LEDMR is not required in the configuration or function of BPL.

Figure 11A:
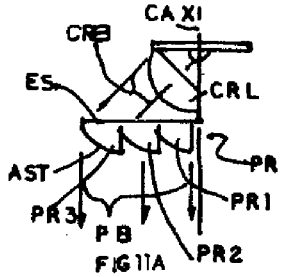
FIG. 11A is a cross-sectional diagram of a detail of FIG. 11.

FIG. 11A is a cross-sectional diagram illustrating a detail of FIG. 11. Refracting plate (ring) PR is comprised of prism rings PR1, PR2, and PR3, all having a common entry surface ES, each prism ring having a spherical or aspherical exit surface typically labeled AST. The function of PR is to bend canted radial beam CRB as collimated beam PB.

FIG. 11B is a cross-sectional diagram of a spot lighting bulb PL that of the optical elements LEDM and PR as described in FIGS. 11 and 11A and further comprised of a container HO, which can be made of a transparent, translucent or opaque. material, which structurally connects Pr to an electrical contact base EB which in turn, via conductors EC provides electrical power to the LEDM modules.

Figure 11C:
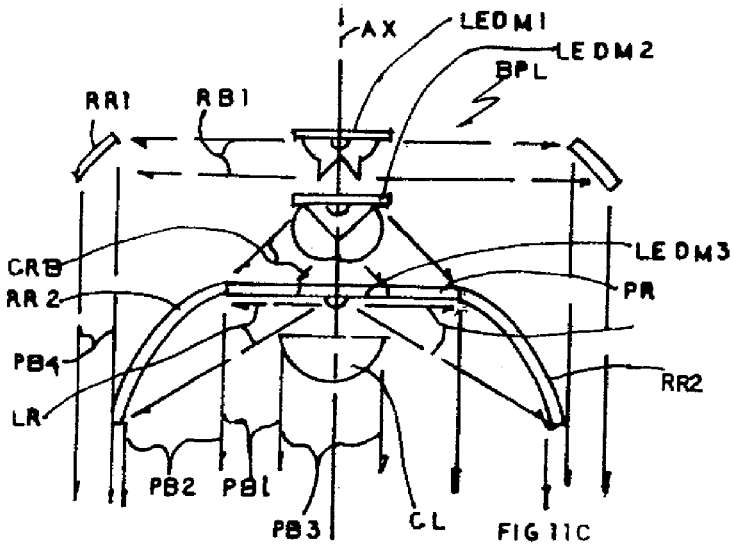
FIG. 11C is a cross-sectional diagram of a beam projecting lighting device comprising optical modules, a reflector ring, and a refracting plate.

FIG. 11C is a cross-sectional diagram of a beam projecting lighting device BPL that incorporates the optical configurations shown in FIGS. 11 and 11A, namely LEDM2 projects canted radial beam CRB towards and onto refracting ring (disk) PR, which redirects CRB as beam PB1, which is substantially parallel or at an acute angle to optical axis AX. PR can be attached to reflector ring RR2, which collects and redirects light LR from LEDM3 as beam PB2, which can be concentric to PB1 or be convergent or divergent to AX. Also, as in my co-pending Utility application Ser. No. 11/034,395, LEDM1 projects radial beam RB1 towards and onto reflective ring CR1 which redirects RB1 as beam PB4, which can be parallel, convergent, or divergent to axis AX. In some embodiments LEDM3 of FIG. 11C, can replace DEDMR of FIG. 11.

FIG. 11D is a cross-sectional diagram of a beam projecting device BPL similar to the BPL shown in FIG. 11C differing in that LEDM3 and PR, of FIG. 11C, are not utilized in FIG. 11D.

Figure 12:
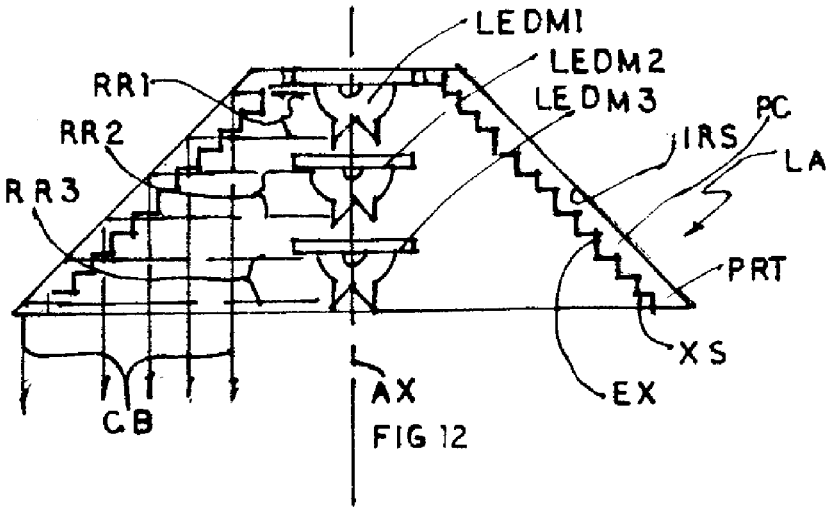
FIG. 12 is a cross-sectional diagram of a lighting assembly comprising radially projecting optical modules.

FIG. 12 is a cross-sectional diagram of a lighting assembly LA which is comprised of a grouping of LEDM modules LEDM1, LEDM,2 and LEDM3 as described in FIG. 11 all sharing a common optical axis AX and each projecting a radial beam RR1, RR2, and RR3 respectively toward and onto a conical reflector PC. PC is comprised of prism rings typically labeled PRT. Each PRT has an entry face, typically labeled ES, an internally reflective surface IRS (common) to all PRT and a surface for light to exit, typically labeled XS. RR1, RR2, and RR3 enter ES are reflected by IRS and exit through XS as beam CB. The function of PRT, including variations to ES and XS are further explained in my U.S. utility Pat. No. 6,616,305 B1.

FIG. 12A s a three dimensional diagram of a lighting assembly LA, the cross-section of which is circular as described in FIG. 12. Unlike PC of FIG. 12 which is substantially conical and would reflect CB as a beam having a circular cross-section. PC is pyramidal and would reflect beam SB as having a substantially rectangular cross-section.

Figure 12B:
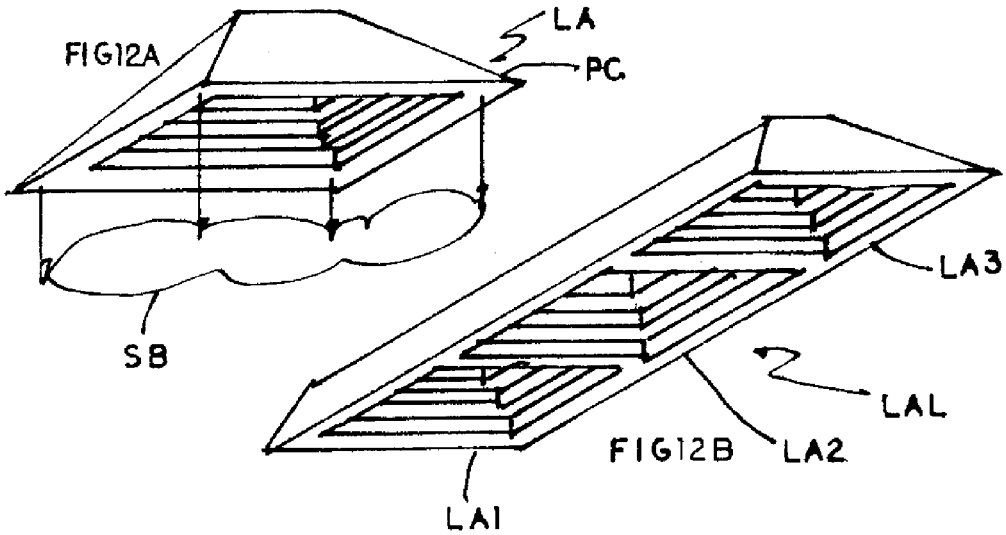
FIG. 12B is a three dimensional diagram of a linear lighting device similar in structure to the lighting device illustrated in FIG. 12A.

FIG. 12B is a three dimensional diagram of a linear lighting device, LAL, comprised of multiple lighting assemblies LA1, LA2, and LA3, each similar to LA of FIG. 12A.

Figure 12C:
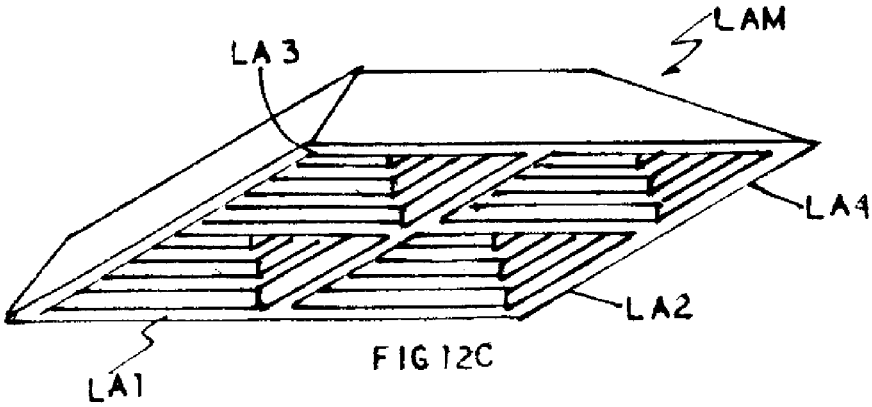
FIG. 12C is a three dimensional diagram of a geometric arrangement of lighting devices as shown in FIG. 12A.

FIG. 12C is a three dimensional diagram of a lighting device LAM comprised of LAM1, LAM2, LAM3, and LAM4.noting that any number of la assemblies can comprise such a device.

Figure 13:
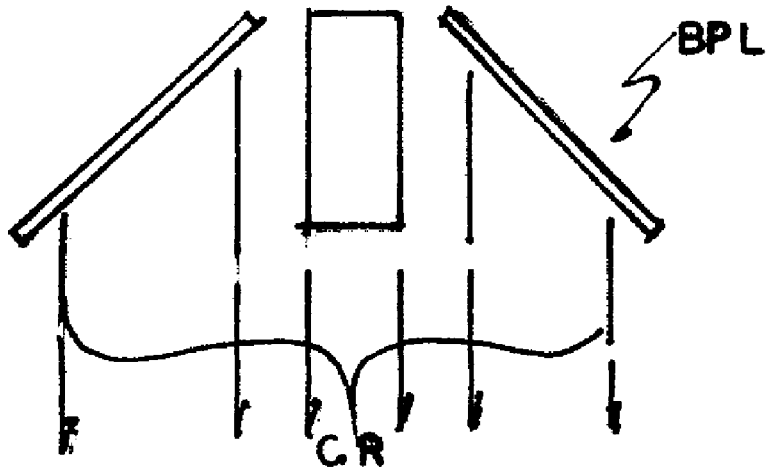
FIG. 13 is a cross-sectional diagram of an image projecting device comprising stacked LED modules.
Figure 13:
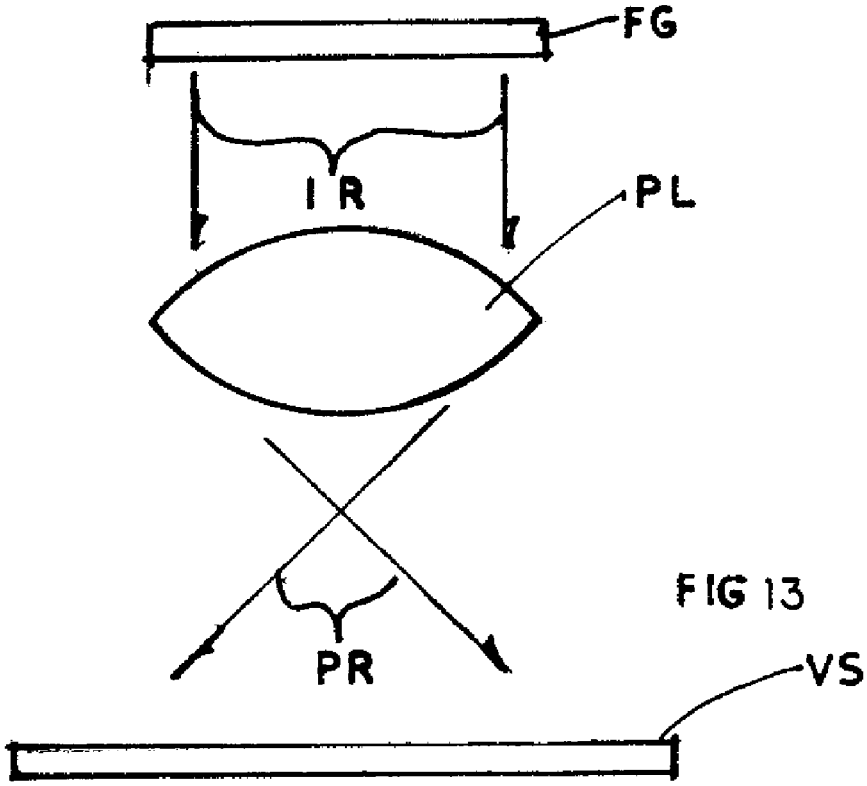

FIG. 13 is a cross-sectional diagram of an image projecting device BPL comprised of a beam projecting device. (The construction and function of the beam projecting device are described in co-pending utility patent application Ser. No. 11/034,395, as embodiments (but not limited to) FIGS. 9, 10, 8A, 11B, 11, 12, 11A, 15, 15 *a*. 16, 17, 18, 17A, 17B, and 21. The construction and function of the beam projecting device is also described as embodiments (but not limited to) FIGS. 11, 11A, 11C, and 12 in the current application.) The image projecting device BPL is further comprised of an optical gate FG, and a projection lens(s) PL. Substantially collimated rays CR are projected onto and through FG (which can comprise an image plate, a liquid crystal plate, an iris, a laming device or any other beam modifying device), as rays IR which are collected by and further projected by PL (which can comprise a single or a composite of lenses) as rays PR towards and onto viewing surface VS, or directly into space.

Figure 1:
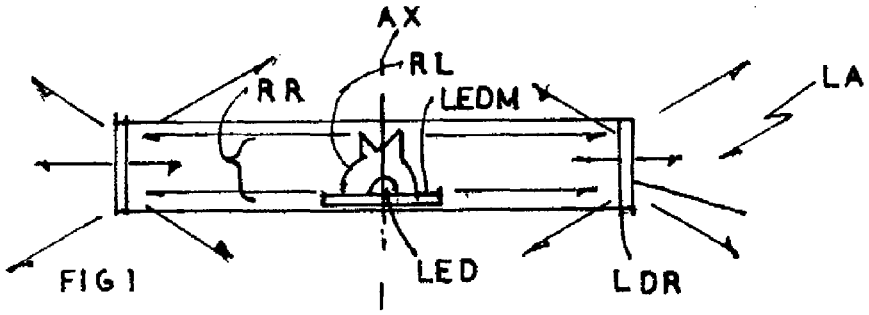
FIG. 1 is a cross-sectional diagram of a lighting assembly comprising a radially collimating element and a light distribution ring.

FIG. 1 is a cross-sectional diagram of a lighting assembly LA comprised of a radially collimating lighting element LEDM (located on an optical axis AX) containing a quasi point light source LED. Such as a light emitting diode, at least partially surrounded by a radially collimating optic RL, and a light distribution ring LDR at least partially surrounding said LEDM that, depending on the composition of LDR either refracts, reflects, or combines both refraction and reflection to alter the direction and or distribution of radial beam RR projected by LEDM. Several configurations of LDR type ring are described in my U.S. utility U.S. Pat. No. 6,616,305 B1.

Figure 2:
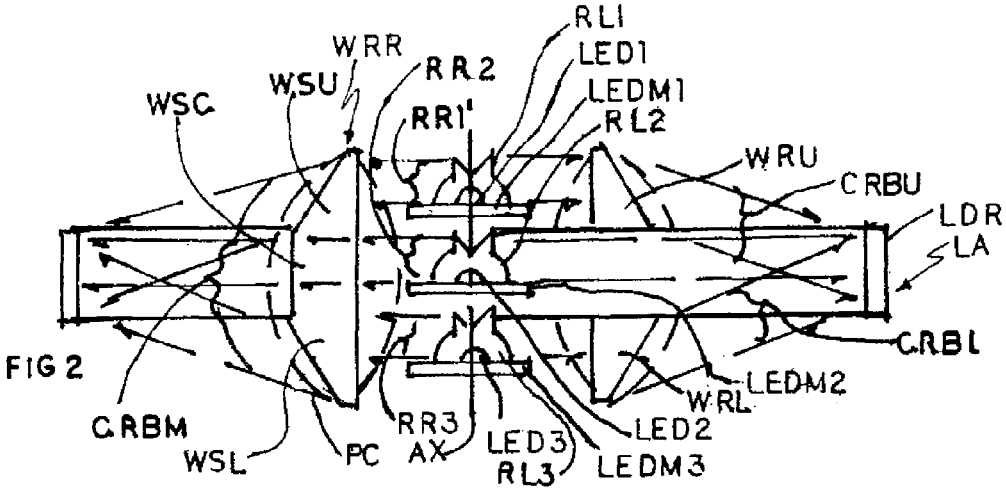
FIG. 2 is a cross-sectional diagram of a lighting assembly similar to that in FIG. 1 comprising several radially collimating elements, and a refracting ring disposed between said collimating elements and said light distribution ring.

FIG. 2 is a cross-sectional diagram of a lighting assembly LA having a similar structure and function as LA in FIG. 1, although, FIG. 2 illustrate the replacement of a single LEDM with a stack of LEDMs, LEDM1, LEDM2 and LEDM3, all located on (or in the proximity of) a common optical axis AX. Although three LEDM modules are shown other quantities can apply. Each LEDM module is comprised of an LED, LED1, LED2, and LED3 respectively and each LED is at least partially surrounded by an RL, RL1 RL2 and RL3 respectively. LEDM1 LEDM2 and LEDM3.respectively project radial beams RR! RR2 and RR3, which are further directed by refracting rings WSU as rays CRBM toward and onto LDR, and by WRU, and WRL, as rays CRBU and CRBL toward and onto LDR.WRU and WRL are wedge prisms in section the function of which is to bend RR1 and RR2 as canted beams CRBU and CRBL toward and onto LDR.RL is comprised of sections WSU and WSL (which function like WRU and WRL respectively) and section WSC which functions as an optical window having no power. Dotted lines PC illustrate that a positive cross-sectional curvature can be applied to any or all surfaces of WRR, WRU and or WRL to further focus CRBM, CRBU, and CRBL.

Figure 3:
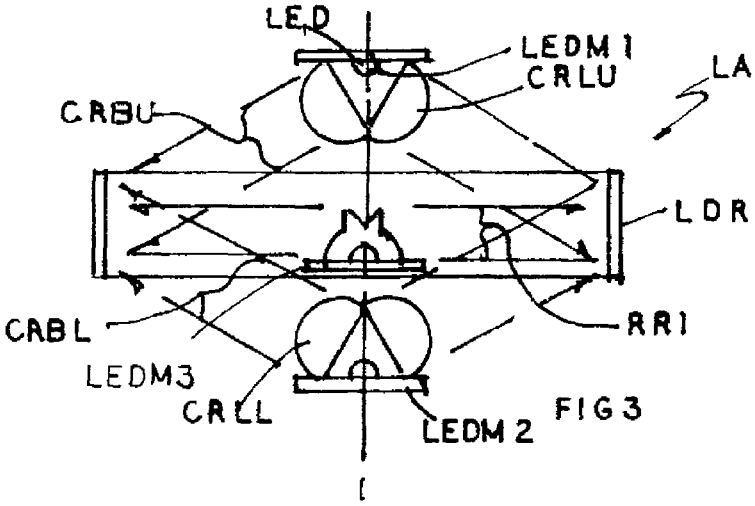
FIG. 3 is a cross-sectional diagram of a lighting assembly as in FIG. 1 wherein said collimating elements project a canted radial beam.

FIG. 3 is a cross-sectional diagram of a lighting assembly LA similar in function to LA of FIG. 2, differing in that the collimating ring optics CRLU of LEDM1 and CRLL of LEDM2 project canted radial beams CRBU and CRBL directly toward and onto LDR, while LEDM3 projects a non canted beam toward and onto LDR.

Figure 3A:
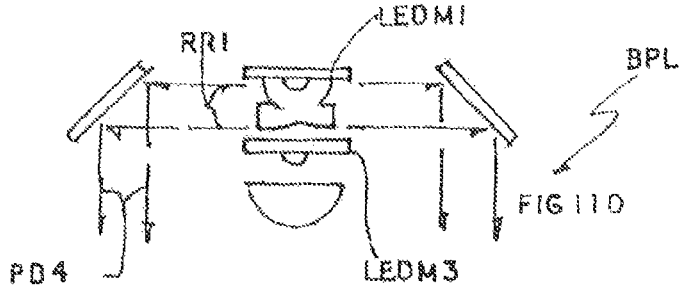
FIG. 3A is a diagrammatic view of a light bulb, comprising elements described in FIGS. 1, 2, and 3.
Figure 3A:
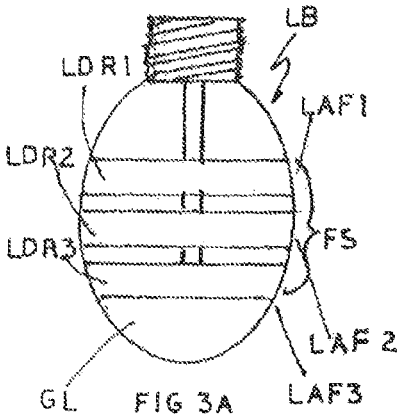

FIG. 3A is a diagrammatic view of a light bulb LB, comprised of a single or multiple of one type, or combined multiple of several types of LAs as illustrated in FIGS. 1, 2, and 3, wherein LDR1, LDR2, and LDR3 can be on the bulb surface GL as a diffusing or refracting pattern FS or cover the entire surface of the bulb.

Figure 3B:
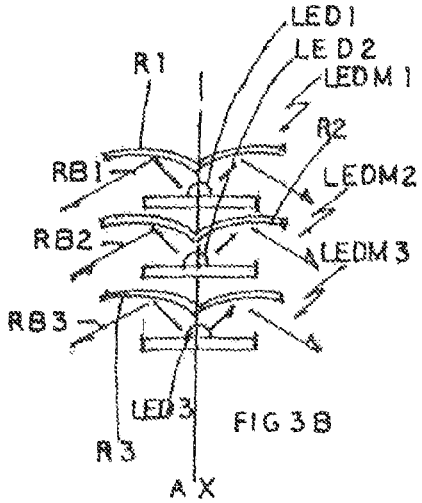
FIG. 3B is a cross-sectional diagram of a group of light projecting modules comprising reflectors.

FIG. 3B is a cross-sectional diagram of a group of LEDM modules LEDM1, LEDM2, and LEDM3, each located on optical axis AX and each comprised of an led, LED1, LED2, and LED3 respectively, and a reflector ring R1, R2, and R3 (which may be parabolic ellipsoidal or radial in section) that collect and reflect light from the LEDs as radial rays RB1, RB2, and R133 respectively.

Figure 4:
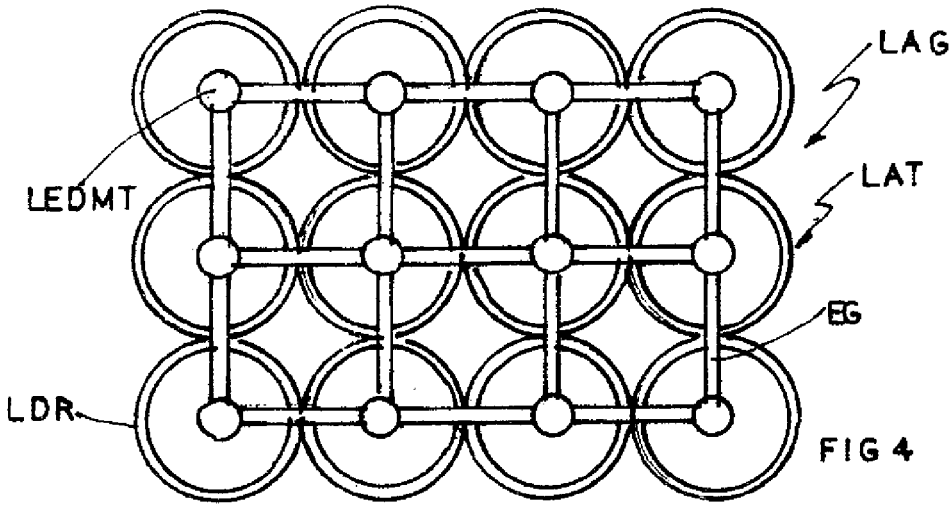
FIG. 4 is a plan view diagram of a geometric arrangement of lighting assemblies as described in FIGS. 1 through 3.

FIG. 4 is a plan diagram of a geometric arrangement LAG of typical LA lighting assemblies as described in FIGS. 1, 2, and 3. The typical LEDM modules LEDMT (also described in FIGS. 1, 2 and 3) receive electrical power through a grid EG comprised of electrical conductors. These conductors can be part of a structural system for the mechanical support of LAT.

Figure 4A:
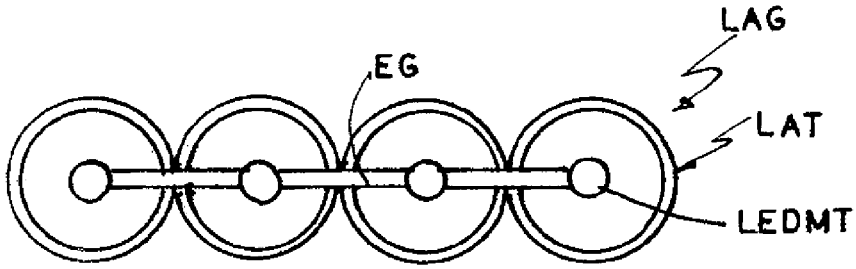
FIG. 4A is a plan view diagram of a linear arrangement of lighting assemblies as described in FIGS. 1 through 3.

FIG. 4A is a plan view diagram of a linear arrangement LAG, of typical LA lighting assemblies LAT comprised of typical LEDM modules that receive electrical power from linearly arranged conductors that can function as structural elements that support the arrangement of LAT.

Figure 4B:
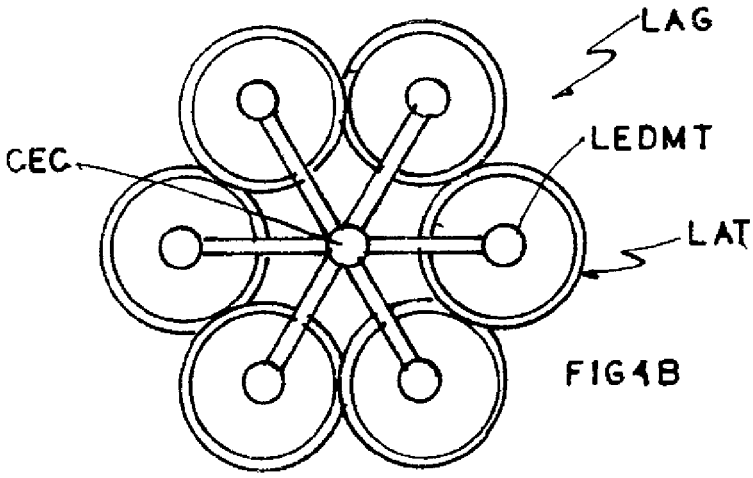
FIG. 4B is a plan view diagram of a spoke-like arrangement of lighting assemblies as described in FIGS. 1 through 3.

FIG. 4B is a plan view diagram of a geometric arrangement LAG of LAT, wherein electrical power is distributed to the LEDTM through a spoke like configuration of electrical conductors.

Figure 4C:
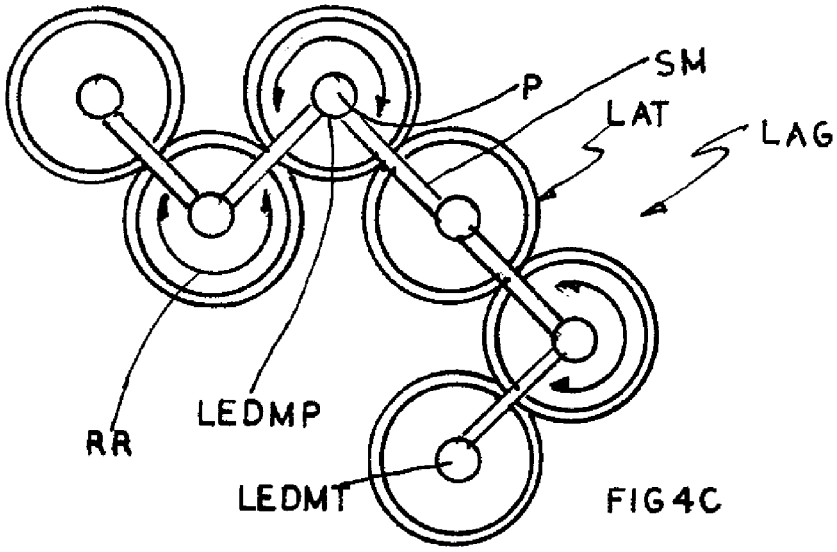
FIG. 4C is a plan view diagram of lighting assemblies that can pivot about each other.

FIG. 4C is a plan view diagram of a typical arrangement of LA lighting assemblies LAT. Each typical LEDM module LEDMT is connected to at least one other LEDMT by a structural member SM, which is joined to an adjacent SM on a mechanical pivot point P, located substantially at the center, LEDMP of an LEDMT, thus allowing the LAT to rotate (arrow RP) around each other.

Figure 4D:
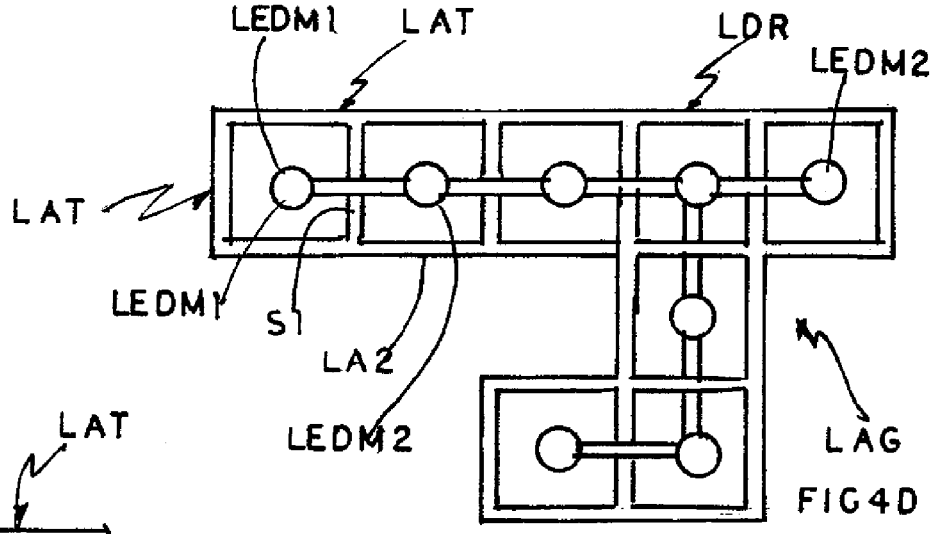
FIG. 4D is a plan view diagram of lighting assemblies in the shape of squares.

FIG. 4D is a plan view diagram of a geometric configuration LAG of LA lighting assemblies LAT wherein the LDR are not circular as shown in FIGS. 1, 2, 3, 4, 4*a*, 4B, and 4C, but square; the sides of which can be shared by 2 LA modules illustrated by side S1 being common to LA1 and LA2. If S1 is refractive, it will refract light it receives from LEDM1 and LEDM2 simultaneously.

Figure 4E:
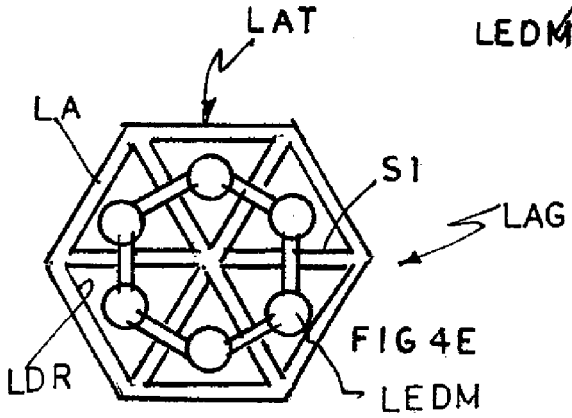
FIG. 4E is a plan view diagram of triangular lighting assemblies geometrically configured.

FIG. 4E is a plan view diagram of a geometric configuration LAG of LA lighting assemblies LAT each in the form of a triangle, and as illustrated in FIG. 4D, side S1 is common to two LA assemblies. LA assemblies can have LDRs of various geometric shapes including both regular and irregular polygons, while LAGs can be configured to contain a symmetric or asymmetric arrangement of varied polygons. Each LA within the described arrangements can contain either a single LEDM or a stacked multiple of LEDMs. Therefore a common side S1 can receive light from a single LEDM on one side and multiple LEDM on its other side.

Figures 5, 5A, 5C, 6, 6A, 7, 7B, 7C:
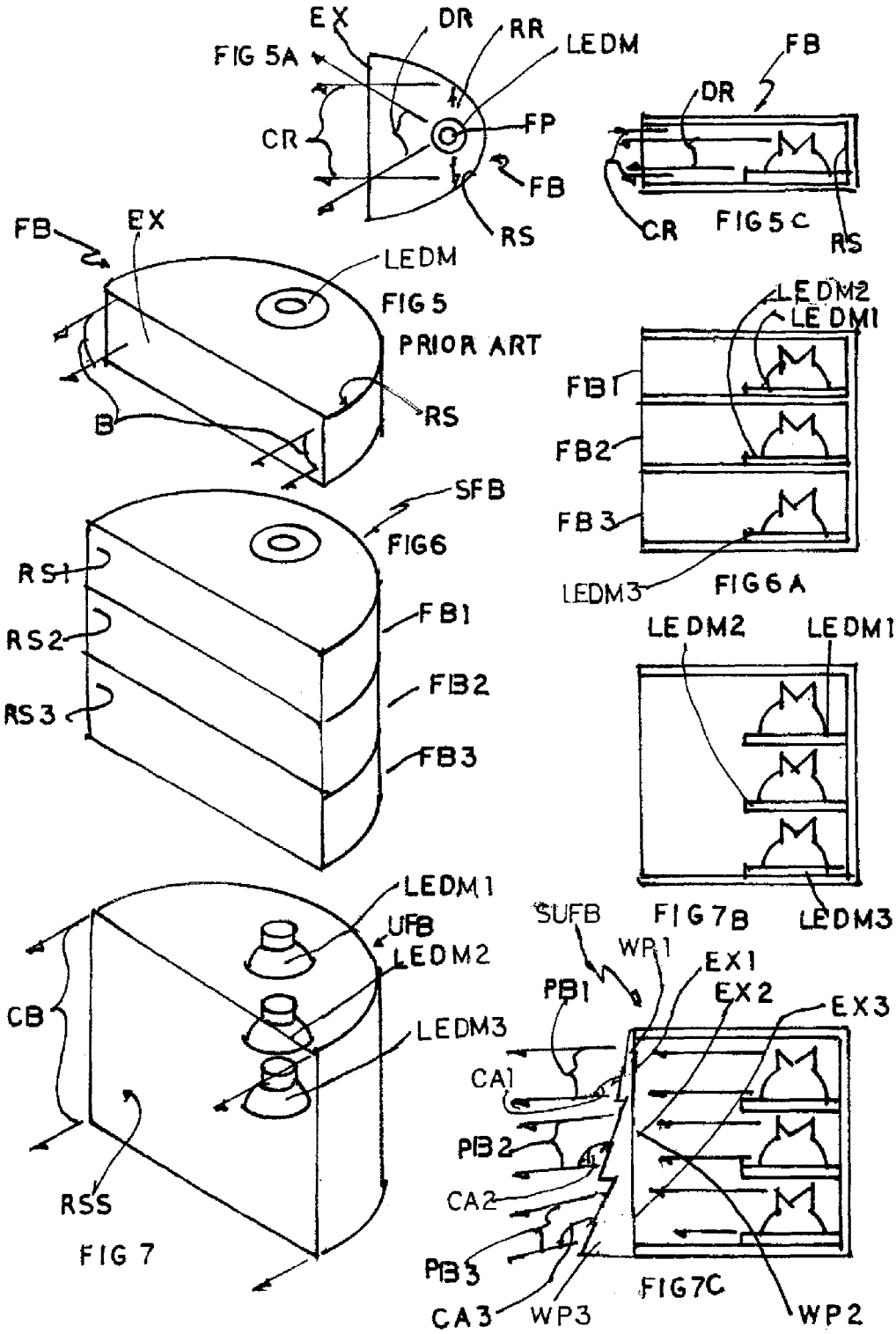
FIG 5 PRIOR ART
FIG. 5 is a three dimensional diagram of a beam projecting device comprising a radial beam projecting module and a reflector disposed to redirect the radial beam in its projected plane.
FIG. 5A is a plan view diagram of FIG. 5 including a ray trace.
FIGS. 5B and 5C are cross-sections of FIG. 5.
FIG. 6 is a three dimensional diagram of a stack of light projecting devices each similar as the light projecting device shown in FIG. 5.
FIG. 6A is a sectional diagram of FIG. 6.
FIG. 7 is a three dimensional diagram of a light projecting device similar to that of FIG. 6 comprising a single reflector.
FIG. 7B is a cross-sectional diagram of FIG. 7.
FIG. 7C is a cross-sectional diagram of a light projecting device similar to the light projecting device illustrated in FIGS. 6, 6A, 7 and 7B, with the addition of wedge prisms disposed on the exit faces.

FIG. 5 is a three dimensional diagram of a beam projecting device FB is comprised of an LEDM module located substantially at the focal point of reflector RS which can be circular, spherical, parabolic, (or a combination of these Curvatures) in plan or in section, which collects a portion of the radial beam projected by LEDM and projects beam B. The functions and optical variations to FB are further taught in my U.S. utility U.S. Pat. No. 5,897,201.

FIG. 5A is a plan view diagram of projecting device FB of FIG. 5 illustrating that radially projected rays RR from LEDM are reflected by RS as rays CR; and in addition radially projected rays DR also projected by LEDM exit FB without being reflected by RS.

Figure 5B:
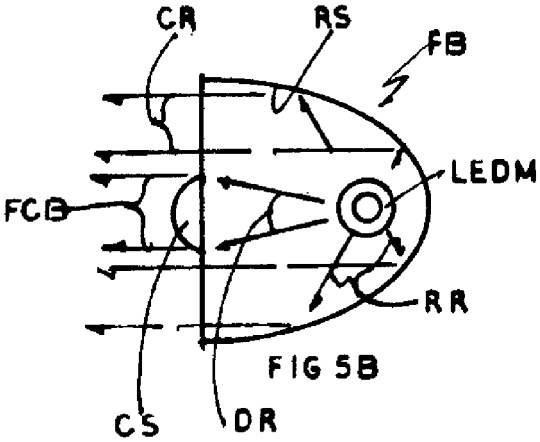

FIG. 5B is a plan view diagram of a beam projecting device FB similar to FB of FIG. 5A with the addition of refracting surface CS which collects and focuses rays DR as beam FCB.

FIG. 6 is a three dimensional diagram of a lighting device SFB which is a stacked composite of FBs, FB1, FB2 and FB3; each partially comprised of individual reflectors RS1, RS2, and RS3, respectively, and each being substantially similar in their optical characteristics and function as FB, described in FIGS. 5, 5A, and 5B.

FIG. 6A is a sectional diagram of FIG. 6.

FIG. 7 is a three dimensional diagram of a light projecting device UFB, differing from SFB of FIG. 6 in that RS1, RS2, and RS3 are replaced by a single reflector RSS. RSS collects and projects the individual radial beams from LEDM1, LEDM2, and LEDM3 as composite beam CB.

FIG. 7B Is a cross-sectional diagram of FIG. 7.

FIG. 7C is a cross-sectional diagram of light projecting device SUFB Illustrating the addition of wedge prisms WP1, WP2 and WP3 to the exit face(s) EX1, EX2, and EX3, each wedge prism is shown to have a different light bending power, resulting in each set of respective rays PB1, PB2, and PB3, being projected by SUFB, having different cant angles CA1, CA2, and CA3, respectively.

Figure 8:
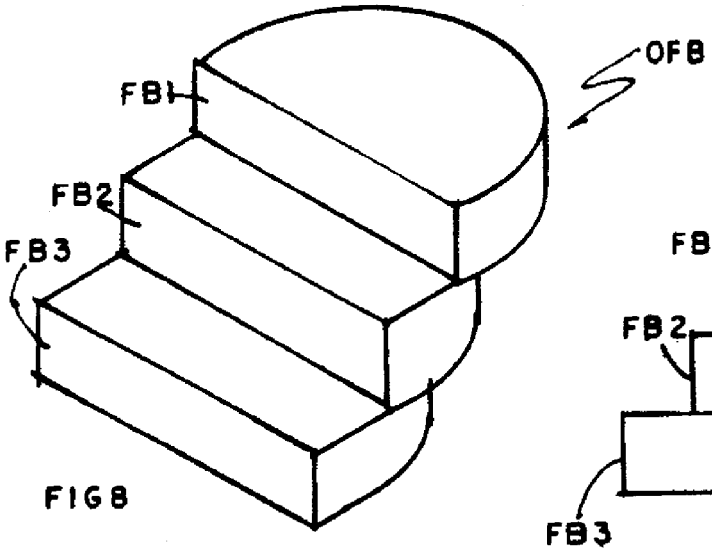
FIG. 8 is a three dimensional diagram of a light projecting device wherein the beam projecting modules are offset from each other.

FIG. 8 is a three dimensional diagram of a beam projecting lighting device OFB comprised of an offset stack of FBs, FB1, FB2, and F133.

Figure 8A:
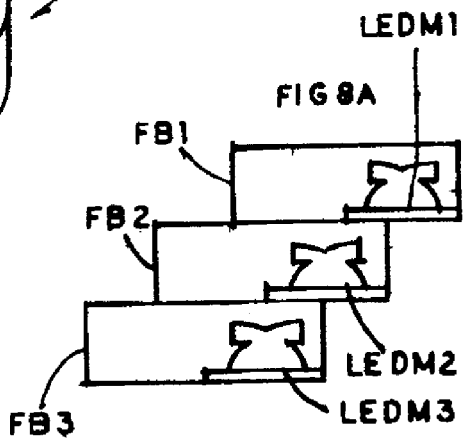
FIG. 8A is a cross-sectional diagram of FIG. 8.

FIG. 8A is a cross-sectional diagram of FIG. 8 illustrating the offset relationship of the LEDM modules.

Figure 8B:
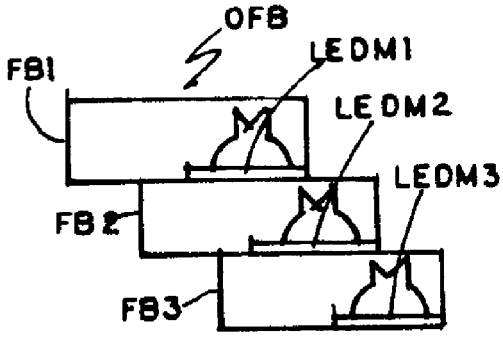
FIG. 8B is a cross-sectional diagram of FIG. 8.

FIG. 8B is a cross-sectional diagram of a lighting device as shown in FIG. 8, having a variation to the offset positions of FB1, FB2, and F.

Figure 14A:
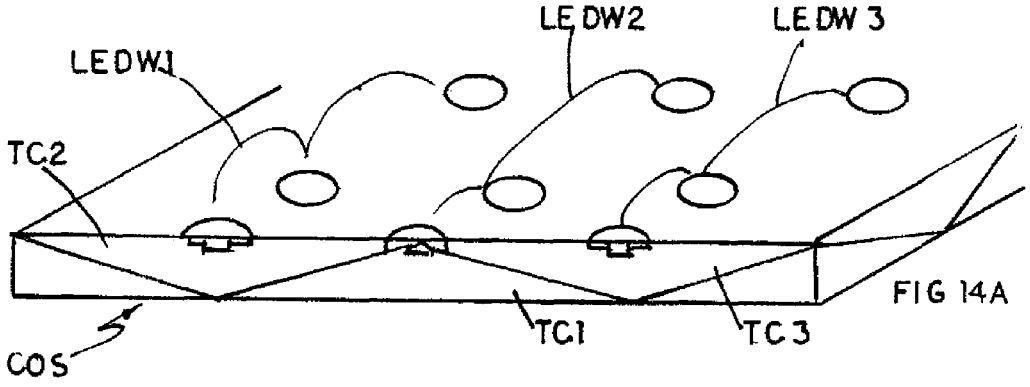
FIG. 14A is a three dimensional diagram of an embodiment of FIG. 14.
Figure 14:
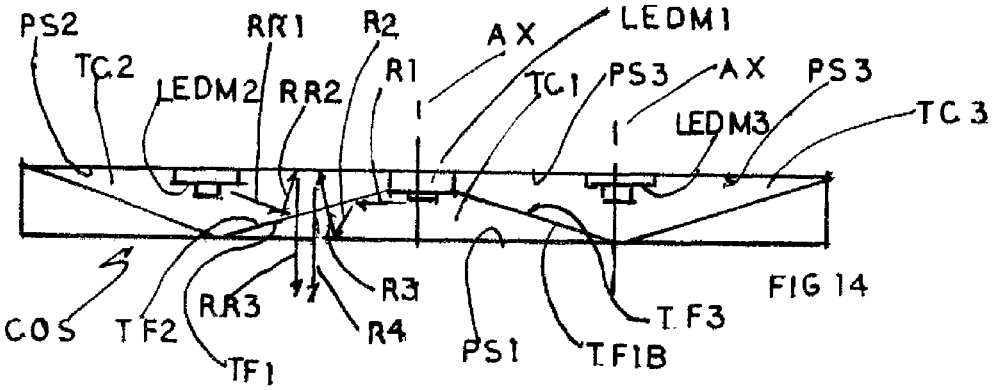
FIG. 14 is a cross-sectional diagram of a compound optical structure comprising tapered light guides.

FIG. 14 is a cross-sectional diagram of a compound optical structure COS, comprised of 3 tapered light guides, TC1, TC2, and TC3, all composed of a clear optical material such as plastic or glass. The tapered faces TF1, TF2, and TF3, of TC1, TC2, and TC3 have substantially the same dimensions and have the same pitch. The non tapered sides of TC1, TC2, and TC3, respectively PS1, PS2 and PS3, are substantially parallel to each other. Each tapered light guide has disposed within at least one module LEDM comprised of a quasi point light source that is at least partially surrounded by a radially collimating optic, which is substantially located on an optical axis AX. AX is typically perpendicular to PS1, PS2, and PS3, (respective surfaces of the light guides which are parallel to each other) and substantially passes through the widest location (the apex) of each light guide. Within TC1, LED1 is located at the substantially at the apex of the light guide. Within TC2, and TC3, LEDM1, LEDM2, are located on or in close proximity to surfaces PS1, and PS2 respectively; however LEDM1, LEDM2, and LEDM3, can be located anywhere along AX within (and in some instances above or below) the light guides. LEDM1, LEDM2, and LEDM3, each project a radially collimated beam labeled R1, projected by LEDM1, and RR1 projected by LEDM2. R1 is internally and acutely reflected by TF1 as rays R2, which in turn is internally reflected by PS1 as rays R3 which in turn is further reflected by PS2, as rays R4, at an obtuse angle to and therefore not internally reflected by surfaces TF2, TF1, and PS1, thus allowing PR4 to pass through TC1 and PC2. In a similar manner ray RR1 is reflected by TF2 as rays RR2 and in turn is reflected by PS2 as rays RR3 which pass through TC2 then TC1, within substantially the same area and substantially the same direction as rays R4. This results in the mixing of light projected by LEDM1 and LEDM2. Although not illustrated in FIG. 14, (for the purpose of simplifying the diagram); a similar ray distribution takes place between LED1 and LED3, as described and illustrated for LED1 and LED3. This described ray distribution allows for the mixing of different colored light projected by colored LEDs within the LEDMs.

FIG. 14A is a three dimensional view of FIG. 14, wherein light guides TC1, TC2, and TC3, are formed as shallow pyramids, TC1 being inverted, its apex pointed 180 degrees to the apices of TC2 and TC3, and further wherein the LEDs are arranged in grids or lines such as those labeled LED1, LED2, and LED3; each of these lines can contain varied arrangements of different colored LEDs, and as described in FIG. 14. These colors can be mixed and homogenized within TC1, TC2, and TC3.

Figure 14B:
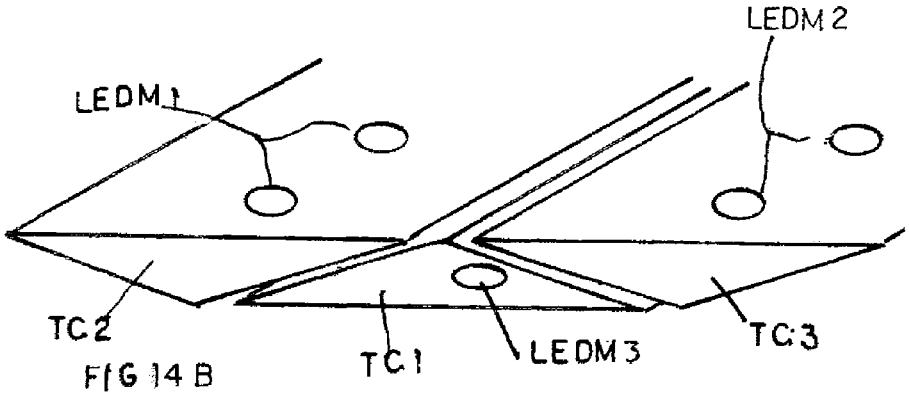
FIG. 14B is a three dimensional diagram of an embodiment of FIG. 14.

FIG. 14B is a three dimensional diagram of an embodiment of the lighting device described in FIG. 14; wherein TC1, TC2, and TC3, are formed as linear prisms.

Figure 15:
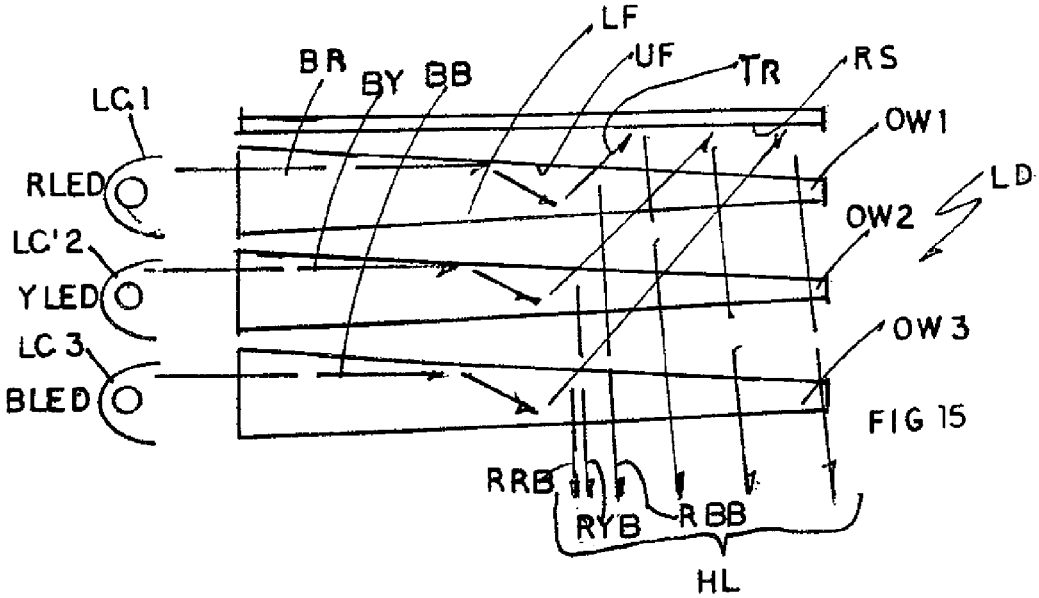
FIG. 15 is a cross-sectional diagram comprising a stack of tapered light guides similar to FIG. 14.

FIG. 15 is a cross-sectional diagram of a lighting device LD designed to mix and homogenize light from multiple quasi point light sources such as LEDs. Further, individual colors can be isolated and projected without mixing. LD is comprised of a stack of tapered optical light guides OW1, OW2, and OW3; each guide receives light from at least one LED, which is of a particular color (illustrated to be but not required) as red RLED, YLED yellow, and blue BLED respectively. The light from each LED(s), is collected by a reflective and or a refractive optical collimating device respectively LC1, LC2, and LC3 respectively, that project beams (indicated as a single rays) of their respective colors BR, BY, and BB toward and into OW1, OW2, and OW3, respectively. The commonly known function of a tapered light guide is to, (by total internal reflection) change the angle of a beam (in respect to the reflecting surfaces) with each sequential reflection until the beam angle is such as to allow the light to pass through and not be reflected by the internally reflecting surface. Referring to this principle, BR is reflected sequentially off surface UF, then LF, exiting OW1 as rays TR, which in turn is reflected by reflecting surface RS as rays RRB that sequentially pass through OW1, OW2, and OW3. Rays BY and BB substantially follow the same optical pathways as BR, exiting LD as RYB and RBB respectively, the colors of which substantially mix as homogenized light HL.

Figure 15B:
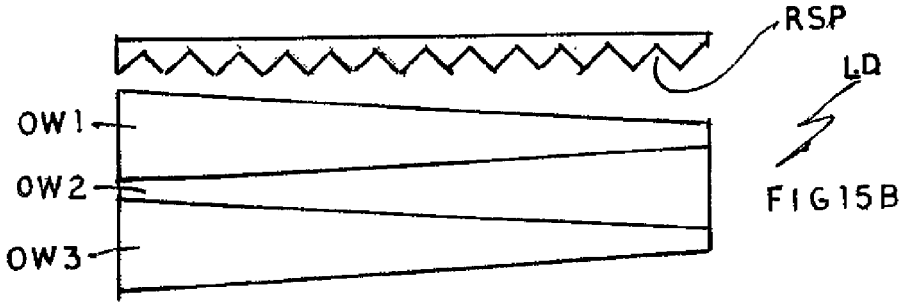
FIG. 15B is a cross-sectional diagram of a stack of tapered light guides and a scattering surface.
Figure 15A:
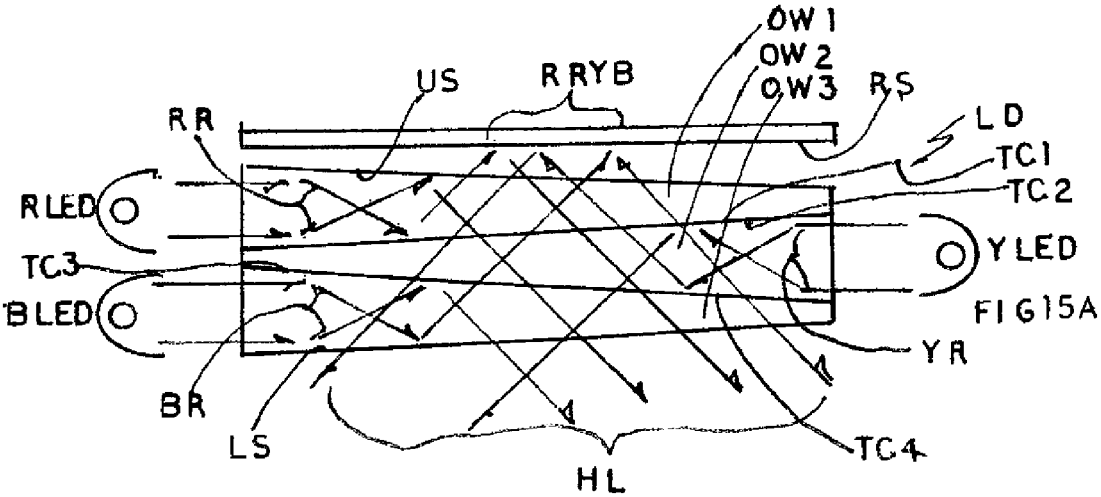
FIG. 15A is a cross-sectional diagram of a stack of tapered light guides comprising reverse (mirror image) tapers.

FIG. 15A is a cross-sectional diagram of a lighting device LD comprised of tapered light guides OW1, OW2, and OW3, that are similar to those described in FIG. 15. The tapered faces TC1 and TC2, of OW1 and OW2 respectively, substantially share the same dimensional plane, and TC3 and TC4 of OW2 and OW3 respectively, also substantially share the same dimensional plane. Unlike LD of FIG. 15, the wider sides of the tapered structures (the sides that receive light from the LEDs), alternate. This is illustrated by the wide side OW1 and OW3 alternating left to right respectively with the wide side of OW2. Further, (as illustrated in FIGS. 14 and 14A), internally reflected rays RR, YR, and BR, emanating respectively from RLED, YLED, and BLED, are internally reflected until their respective angle of incidence to internally reflective surfaces TC1 TC2 and TC3 become such that rays RR, YR, and BR, pass through OW1, OW2, and OW3, and emerge as homogenized light HL. As in FIG. 15, reflective surface RS can be incorporated into LD (as illustrated) to reflect the combined rays RRYB through LD.

FIG. 15B is a cross-sectional diagram of a lighting device similar in structure and function to LD of FIG. 15A, differing in that RS of FIG. 15A is replaced by a light scattering surface RSP.

Figure 15D:
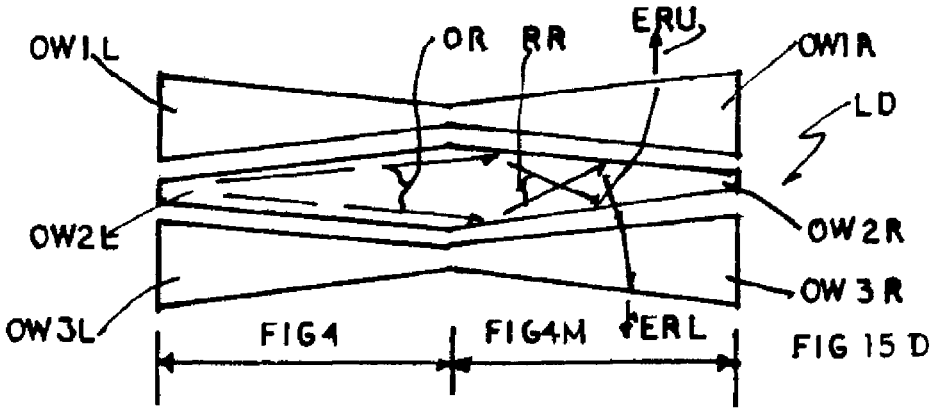
FIG. 15D is a cross-sectional diagram of a lighting device comprising wedge prisms similar to two of the lighting devices shown in FIG. 15A assembled end to end.
Figure 15C:
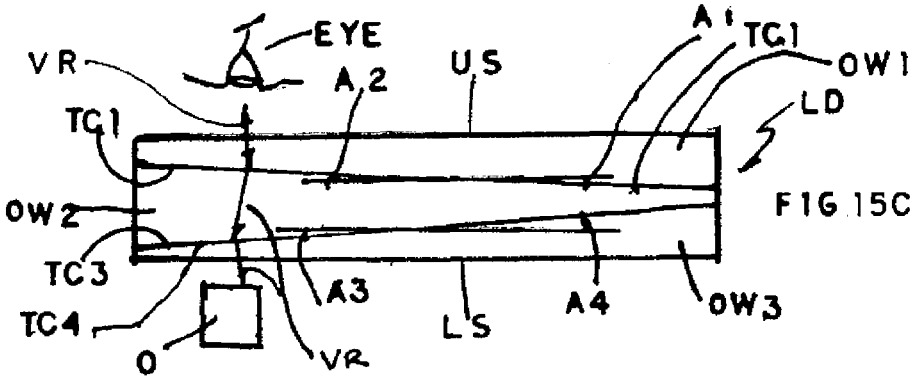
FIG. 15C is a cross-sectional diagram of a lighting device wherein the light guides form an optical window.

FIG. 15C is a cross-sectional diagram of an LD wherein the cant angle A1 of TC1 of OW1, is equal to A2 of TC2 of OW2. Accordingly A3, of TC3 of OW2 is equal to equal to A4 of TC4 of OW3. Since internally reflective faces US of OW1 and LS of OW3 are parallel, LD will act as an optical window so that object O will appear to drawn eye EYE to be in the same position as if LD were not between O and EYE. Ray VR enters and exits LD perpendicular to US and LS respectively. For graphic purposes LEDs are not shown in this diagram.

FIG. 15D is a cross-sectional diagram of a lighting device LD which is configured as LD and its mirror image of FIG. 15A. The function of OW1L and OW1R as well as the function of OW3L and OW3R, are similar to that of OW2 and OW3 of FIG. 15A. The functions and relationships of OW2L and OW2R are as follows. Although rays OR emanating from LEDL (not shown) pass through OW2L, they are not internally reflected until they enter OW3R which functions like OW2 of FIG. 15A, and further illustrated as rays RR that exit LD as ERU and ERL.

Figure 15E:
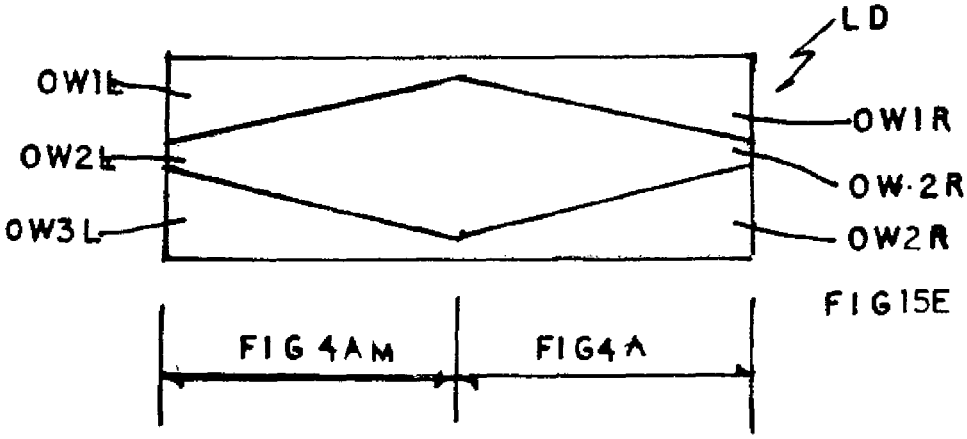
FIG. 15E is a cross-sectional diagram of a lighting device similar in structure and function to both FIGS. 15C and 15D combined.

FIG. 15E is a cross-sectional diagram of an LD. Similar in structure and function to both FIGS. 15C and 15D combined.

FIG. 16 is a sectional diagram of a type of lumenair MBPL that divides the light from a single high intensity quasi point light source QPS (such as a halogen or metal halide bulb), into individual beams QPS by means of geometric groupings MCS of collimating optics CL that surround QPS, which are further surrounded by moveable reflecting optics RS that reflect and direct individually projected beams QPB as beams RQPB. This type of multiple beam projecting device is further described in my U.S. utility Pat. No. 5,130,908 and U.S. Pat. No. 6,270,243 B1. Mounted to RS is a light emitting diode LED, which in FIG. 16, is mounted behind RS, that projects beam LEDB, the rays of which are substantially parallel to the rays of RQPB no matter the angle MM that RS is positioned.

FIG. 16A is a side view diagram of RS of FIG. 16 illustrating two beam projectors BPLEDs that are projecting two LEDBs substantially in the same direction as reflected beam RQPB.

FIG. 16B is a planar view of RS, illustrating four LEDs mounted to RS, further illustrating that any number, of BPLEDs can be mounted to an RS to increase or decrease the brightness of the light reflected and projected by RS. In FIGS. 16, 16A and 16B, beams LEDB are derived from BPLEDs mounted behind and project light through RS.

FIG. 16C illustrates an alternative mounting of BPLEDs to RS, namely that of mounting BPLEDs to the front surface of RS. I is noted that the reflecting surface BS as well FS can respectively be on the back or front of RS.

FIG. 16D illustrates another optical configuration for maintaining directional continuity between RQBP and LEDB. This is achieved by mounting an LED that is at least partially surrounded by a radially projecting optic RLED within an RS, which has the cross-section of a planar optical light guide LGC. RLED projects radially collimated beam RCB through LGC, and is intercepted and reflected forward by reflecting surface IRS, in substantially the same direction as reflected beam RQPB. The function of radially collimated light in relationship to planar light guides is further explained in U.S. utility Pat. No. 5,897,201.

FIG. 16E is a planar diagram of FIG. 16D illustrating RLED projecting radial beam RCB through LGC onto IRS.

Figure 17:
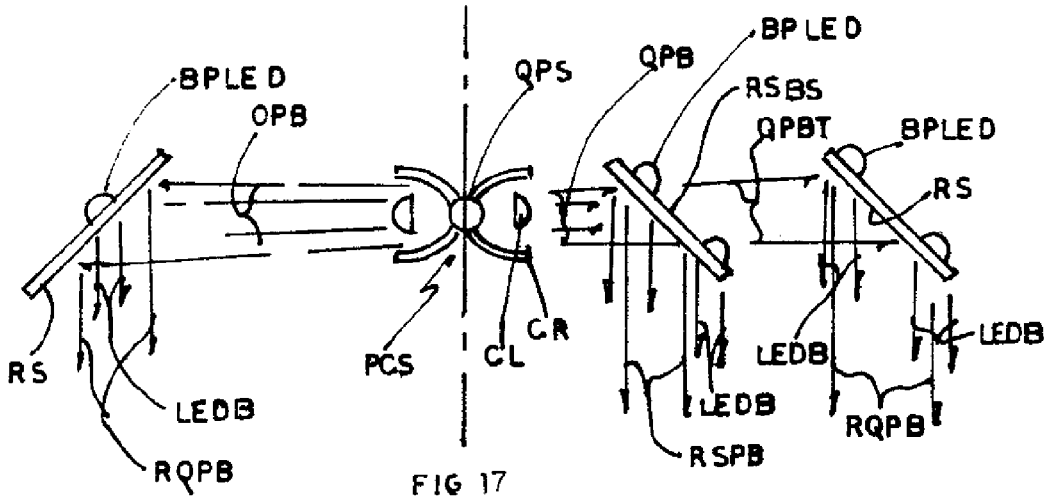
FIG. 17 is an illustration of a variation of the optical lumenaire shown in FIG. 16.

FIG. 17 illustrates a similar optical lumenair configuration as that of FIG. 16, differing in that the grouping of collimating optics in FIG. 16 is comprised of individual lenses CL while the collimating optics of FIG. 17 is comprised of lenses CL and reflectors CR. The combined optical assembly of CL and CR project substantially collimated beams QPB, which shown on the left side of FIG. 17, are reflected by RS as RQPB, the rays of which are projected in substantially the same direction as rays LEDB projected by BPLED. The combination of LEDB and RQPB can be produced by (but are not limited to) the optical configurations illustrated in FIGS. 16A, 16B, 16C, 16D and 16E. The QPB projected on the right side of FIG. 17 is reflected by and passes through beam splitter RSBS as QPBT which in turn is reflected by RS as beam RQBP. LEDB is substantially parallel to RSBP and LEDD is substantially parallel to RQPB. The combination of BPLED and RSBS can be of optical configurations similar (but not limited) to the optical combined configurations of RS and BPLED previously discussed. The quasi point light sources such as halogen or HID are generally deficient in certain wavelengths in the lighting spectrum as compared with day lighting. By combining and substantially homogenizing the light from these sources with the various colors available with light emitting diodes, the spectrum of artificially produced light can be made similar to that of natural (day)light.

Figure 9A:
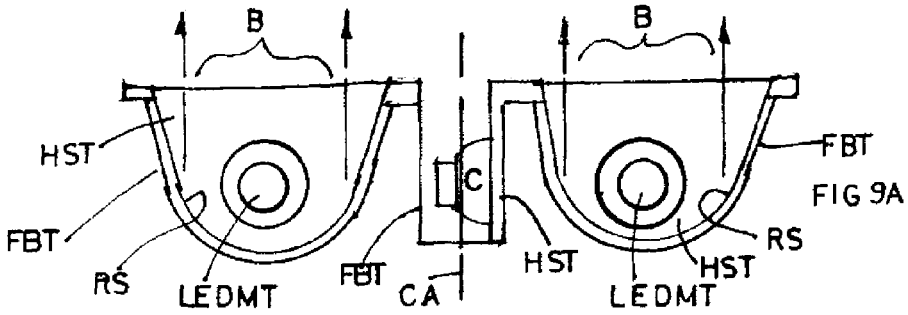
FIG. 9A is a cross-sectional diagram of FIG. 9.
Figure 9:
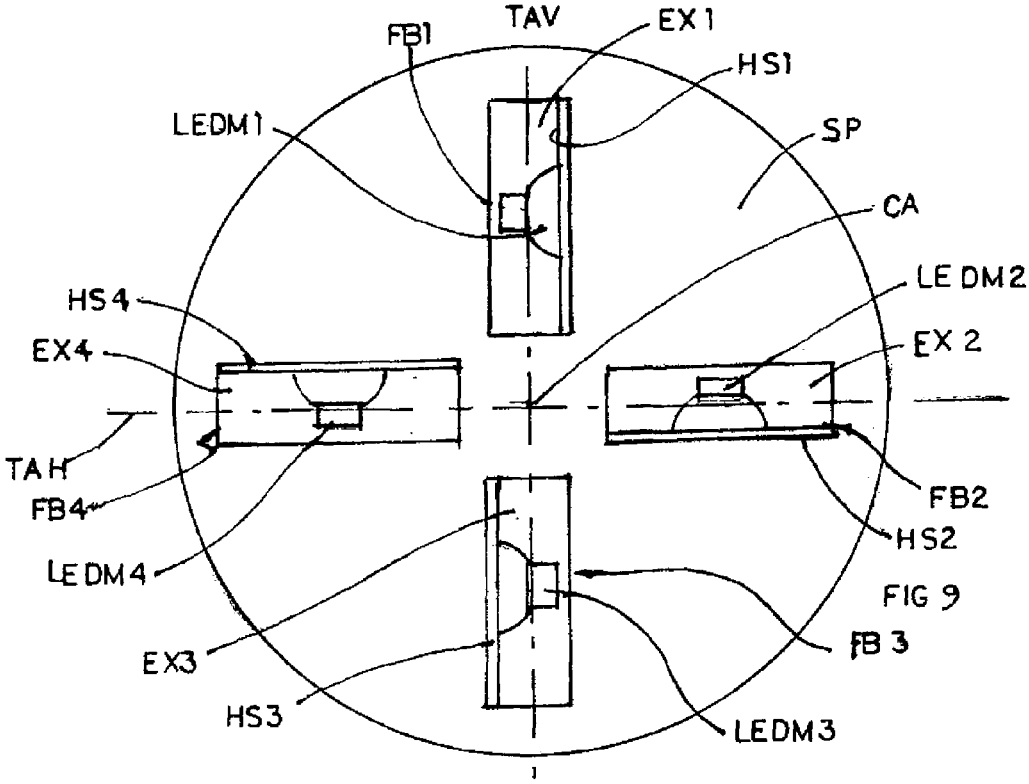
FIG. 9 is a plan view diagram of a geometric arrangement of beam projecting devices illustrated in FIG. 5.

FIG. 9 is a plan view of a light projecting device and comprising beam projecting devices FB1, FB2, FB3 and FB4 as described in FIGS. 5 and 5A, the exit faces EX1, EX2, EX3 and EX4 are substantially disposed along transverse axes TAH and TAV, radiating outward from central axis CA and lie substantially on plane SR LEDM, LEDM2, LEDM3 and LEDM4 are thermally attached to heat sinks HS1, HS2, HS3 and HS4 respectively which comprise one surface of the FB device. Although 4FB devices are shown, more or fewer devices can be arranged along SP.

FIG. 9A is a cross-sectional diagram of the light projecting device illustrated in FIG. 9 illustrating typical FB devices comprised of reflecting surface RS, LEDM modules projected beams B, and heat sings HST.

Figure 9B:
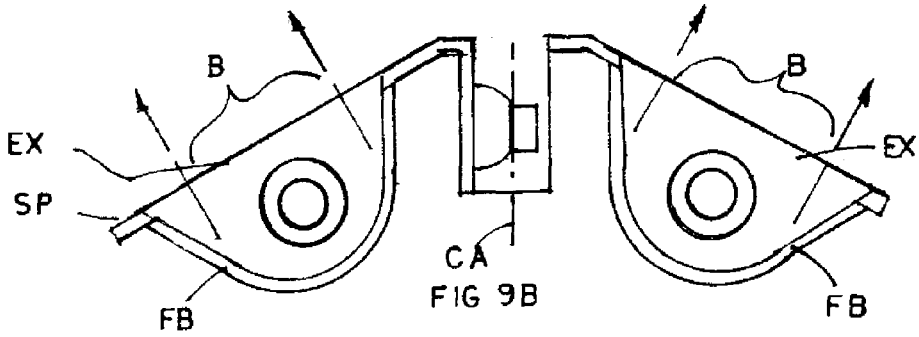
FIG. 9B illustrates a variation to FIGS. 9 and 9A, wherein the exit faces of the beam projection devices are at a cant to the central axis.

FIG. 9B is a cross-sectional diagram of a light projection device similar to that shown in FIG. 9 differing in that SP is conical resulting in exit faces EX disposed at an angle other than 90° to the central axis CA, beam B are projected at an angle to the central axis.

Figure 9C:
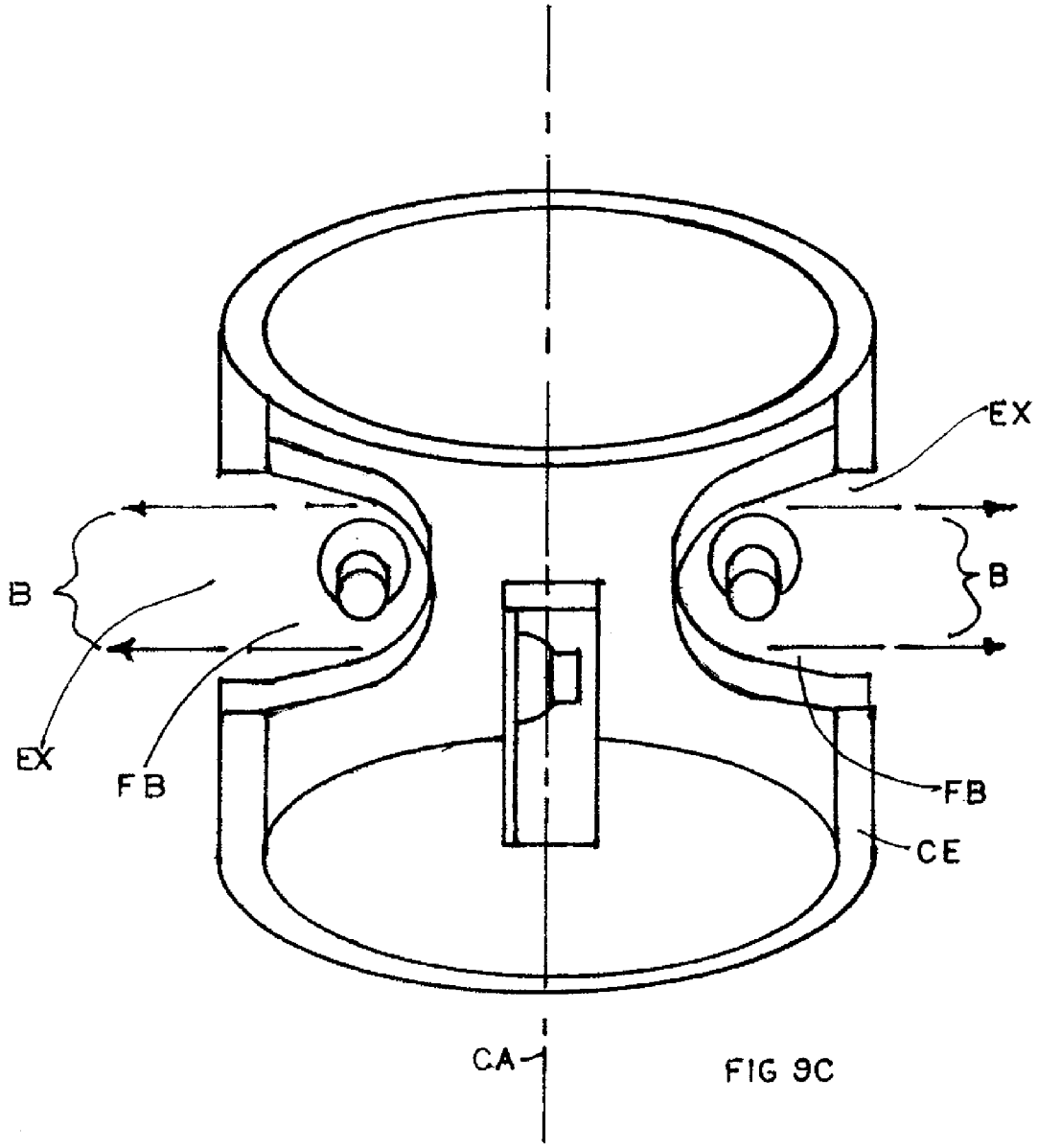
FIG. 9C is a three dimensional diagram of the exit faces of the beam projecting devices of FIG. 5 and are disposed on a cylinder.

FIG. 9C is a three dimensional diagram of a light projection device similar to the described in FIG. 9B differing in that the EX surfaces of the FB module lie within and on the surface of a cylinder CE. CE can be totally transparent or transparent where CE co joins EX. The EX can be substantially parallel to or at an angle the central axis or the cylinder CE, and each or all FBs can be located at different positions in respect to the length of CE and axis CA.

Figure 10A:
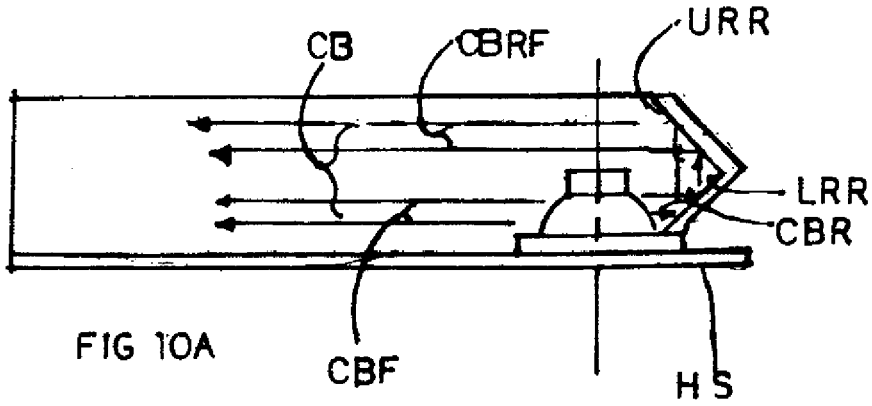
FIG. 10A is a cross-sectional diagram of FIG. 10.
Figure 10:
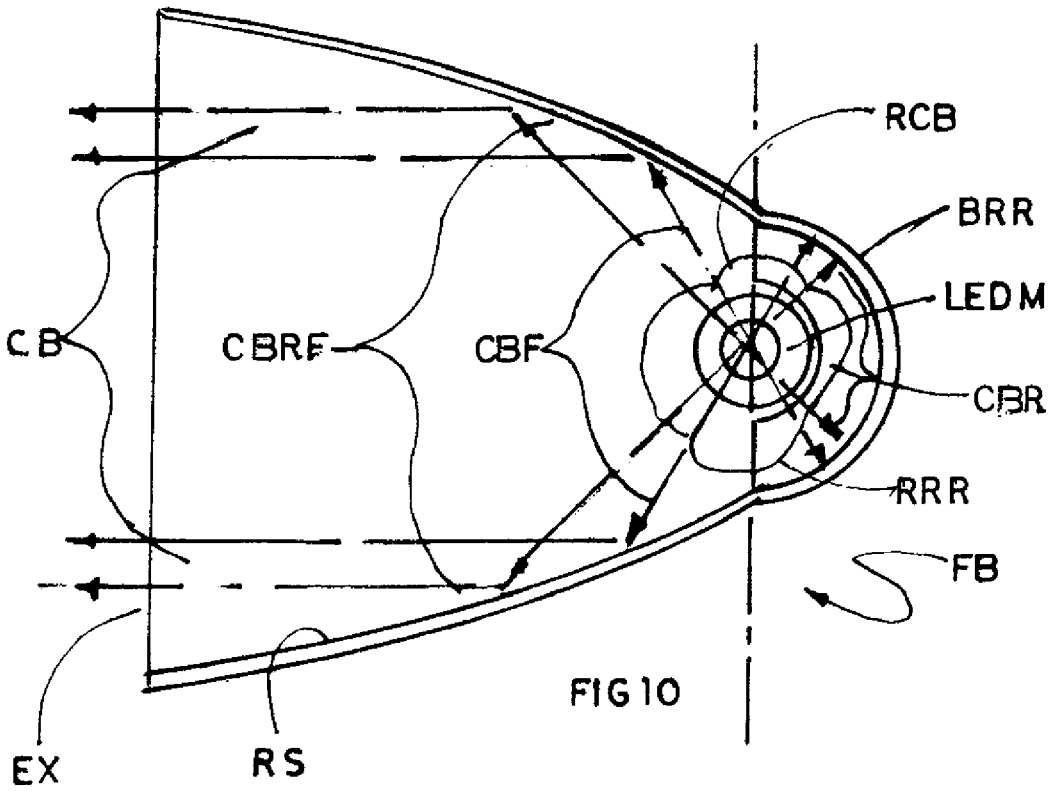
FIG. 10 is a plan view of a beam projecting device as illustrated in FIGS. 5 and 5A having a beam reversing reflector.

FIG. 10 is a plan view cross sectional diagram of an FB module comprised of an LEDM module which is further comprised of an LED at least partially surrounded by a radially collimating optical ring projecting that projects a substantially planar radially collimated beam RCB. A radial portion of RCB, CBF is projected onto and reflected by reflector RS. Another radial portion of RCB, CBR is projected onto beam reversing reflector BRR which redirects CBR in substantially the same radial direction as CBF as radial beam CBRF. A portion of CBRF is projected onto and reflected by RS and combine with CBF to form combined reflected beam CB.

FIG. 10A—is a cross sectional view of FIG. 10 illustrating the lower reflector cone LRR reflecting CBR onto upper reflecting cone URR which further directs CBR as CBFR in the same direction as CBF to further combine as CB.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

The invention claimed is:

1. A beam projecting luminaire comprising:

a. at least one quasi point light source;

b. at least one radially collimating optic;

c. at least a first and second reflecting surface;

d. at least one beam module, including at least said one quasi point light source , and at least partially surrounded by at least said one radially collimating optic, each module being constructed and arranged to project a cylindrically shaped, radially collimated beam onto said first and second reflecting surfaces, respectively;

e. said first reflecting surface partially surrounding said radially collimating optics, said first reflective surface being disposed within the same plane as the radially collimated beam, reflecting and focusing a first portion of said radially collimated beam as a first collimated beam having a rectangular cross section as it exits the first reflective surface and being projected parallel with and in the same radial plane as said radially collimated beam; and f. said second reflective surface comprising an upper reflective cone (URR) and a lower reflective cone (LRR) having the wider diameters of the upper and lower reflector cones facing each other; wherein said second reflective surface is disposed within the same plane as the radially collimated beam, and wherein said second reflective surface reflects and redirects a second portion of the radially collimated beam onto the first reflecting surface as a second planar collimated beam having the same shape and direction parallel to the first planar collimated beam.

2. A luminaire as in claim 1 wherein there are at least two said beam modules that share a common, optical axis.

3. A luminaire as in claim 2 wherein at least one of said first and second reflecting surface is common to at least two of said quasi point light sources.

4. A luminaire as in claim 1 wherein there are at least two beam modules and there is a central axis and said beam modules are disposed to radiate outwardly from and surround said central axis.

5. A luminaire as in claim 4 wherein at least one of the beam modules are arranged on a planar surface, the exit faces of said modules being disposed substantially along radii emanating from said central axis, projecting a collimated beam perpendicular to the central axis.

6. A luminaire as in claim 4 wherein each beam module has an exit face and the exit face of at least one of said beam modules lies on a radius which is canted at an acute angle with respect to said central axis.

7. A luminaire as in claim 4 wherein each beam module has an exit face and the exit face of at least one beam module projects a collimated beam and is parallel to said central axis.

8. A luminaire as in claim 1 wherein at least one module includes a wedge prism through which the collimated beams pass.

9. A luminaire as in claim 1 wherein at least two beam modules that are offset from each other and disposed along parallel planes.

10. A luminaire as in claim 1 wherein said beam module has an exit face and the exit face of at least one of said beam modules includes a lens.

11. A lighting assembly as in claim 1 wherein at least one of said light projecting modules includes at least two quasi point light sources each at least partially surrounded by a collimating optic.

* * * * *